US008641444B2

(12) United States Patent
Yoshida et al.

(10) Patent No.: US 8,641,444 B2
(45) Date of Patent: Feb. 4, 2014

(54) HEAT RADIATING CONNECTOR

(75) Inventors: Haruki Yoshida, Makinohara (JP); Yoshiaki Ozaki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/387,048

(22) PCT Filed: Apr. 6, 2011

(86) PCT No.: PCT/JP2011/059126

§ 371 (c)(1),
(2), (4) Date: Jan. 25, 2012

(87) PCT Pub. No.: WO2011/136019

PCT Pub. Date: Nov. 3, 2011

(65) Prior Publication Data

US 2012/0122345 A1 May 17, 2012

(30) Foreign Application Priority Data

Apr. 28, 2010 (JP) ..... 2010-103403

(51) Int. Cl.
*H01R 13/00* (2006.01)

(52) U.S. Cl.
USPC ..... 439/487

(58) Field of Classification Search
USPC ..... 439/486–487, 625–626
See application file for complete search history.

(56) References Cited

U.S. PATENT DOCUMENTS

| | | | | |
|---|---|---|---|---|
| 5,308,920 | A * | 5/1994 | Itoh | 174/15.2 |
| 6,059,602 | A * | 5/2000 | Ward | 439/465 |
| 6,089,924 | A * | 7/2000 | Wang | 439/694 |
| 6,733,325 | B2 * | 5/2004 | Sakai et al. | 439/495 |
| 8,342,880 | B2 * | 1/2013 | Kato et al. | 439/595 |
| 2011/0014822 | A1 | 1/2011 | Kato et al. | |

FOREIGN PATENT DOCUMENTS

| | | | |
|---|---|---|---|
| JP | 62-197271 | U | 12/1987 |
| JP | 6-44049 | U | 6/1994 |
| JP | 2008-071655 | A | 3/2008 |
| JP | 2009-211976 | A | 9/2009 |

* cited by examiner

*Primary Examiner* — Chandrika Prasad
(74) *Attorney, Agent, or Firm* — Sughrue Mion, PLLC

(57) ABSTRACT

For an object of providing a connector which has improved heat radiating efficiency, the connector includes a terminal 2 including a wire connecting portion 21 which an electric wire is connected, and a connector housing 3 provided with a terminal receiving section 30 receiving the terminal 2. Heat radiating portions 45, 55 are provided at a position of the terminal receiving portion 30, at which the wire connecting portion 21 is covered. In the heat radiating portions 45, 55, a plurality of projections 49, 59 formed to project from the surface 4*a*, 5*a* of the terminal receiving section 30 is arranged at intervals to each other.

5 Claims, 4 Drawing Sheets

HEAT RADIATING CONNECTOR

CROSS REFERENCE TO RELATED APPLICATIONS

This application is a National Stage of International Application No. PCT/JP2011/059126 filed Apr. 6, 2011, claiming priority based on Japanese Patent Application No. 2010-103403, filed Apr. 28, 2010, the contents of all of which are incorporated herein by reference in their entirety.

TECHNICAL FIELD

This invention relates to a connector for supplying electric power from an electric power supply to various electronic devices.

BACKGROUND ART

In a vehicle as a mobile body, a connector for supplying electric power from an electric power supply to various electronic devices is provided. The usual connector includes an electric wire, a terminal connected with the electric wire and a housing having a pair of clamp portions clamping the terminal therebetween. The terminal includes a wire connecting portion to be joined with the electric wire and an electric contact portion continuous to the wire portion integrally as one body (see Patent Document 1)

CITATION LIST

Patent Document 1: Japan Patent Publication Application No. 2009-211976

SUMMARY OF INVENTION

Objects to be Solved

At the present time, relatively larger electric current (large current) flows through the electric wire according to higher performance of the electronic device. Thereby, the wire connecting portion of the terminal joined with the electric wire, which the large current flows through, is especially heated by a contact resistance between the electric wire and the terminal to be joined with the electric wire. Heat generated at the wire connecting portion is transferred to the housing so that the housing may be deformed by the heat.

The wire connecting portion of the terminal of the usual connector to be joined with the electric wire is arranged in the housing so as to be clamped between the pair of clamp portions of the housing. Therefore, the wire connecting portion is surrounded by the housing so that the heat is stored in the housing. Thereby, the housing may be deformed by the heat.

For solving the above problem, an object of the present invention is to provide a connector which is improved about heat radiation.

How to Attain the Object of the Present Invention

In order to overcome the above problems and attain the object, the present invention claimed in claim 1 is to provide a connector including a terminal having a wire connecting portion to be joined with an electric wire, and a housing having a terminal receiving section receiving the terminal, and the terminal receiving section is provided with a heat radiating portion at a position to cover the wire connecting portion, and at the heat radiating portion, a plurality of projections projecting from a surface of the terminal receiving section is arranged at a regular interval with a space to each other.

The present invention claimed in claim 2 is characterized in the invention claimed in claim 1 by that the terminal receiving section is structured by a pair of clamp portions clamping the terminal between the pair of clamp portions, and tops of the plurality of projections in a direction, along which the pair of clamp portions approaches to each other, are arranged in one plane.

The present invention claimed in claim 3 is characterized in the invention claimed in claim 1 or 2 by that a plurality of terminals is arranged at intervals to each others, and a plurality of terminal receiving sections is connected to each other in a direction, along which the plurality of terminals is arranged, and the terminal receiving sections adjacent to each other are arranged respectively at positions different from each other in a direction intersecting both a lengthwise direction of the electric wire and the direction, along which the plurality of terminals is arranged.

Effects of the Invention

According to the present invention claimed in claim 1, the connector including the terminal having the wire connecting portion to be joined with the electric wire, and the housing having at least one terminal receiving section receiving the terminal, and the terminal receiving section is provided with the heat radiating portion at the position to cover the wire connecting portion, and at the heat radiating portion, the plurality of projections projecting from the surface of the terminal receiving section is arranged at a regular interval with the space to each other. Thereby, a surface area of the terminal receiving section is increased, so that the heat generated by contact resistance between the electric wire and the terminal joined with the electric wire can be easily diffused (radiated). The heat radiating portion is arranged at the position to cover the wire connecting portion generating heat by the contact resistance, so that the heat can be efficiently radiated. Thus, the connector which is improved about heat radiation can be provided.

According to the present invention claimed in claim 2, the terminal receiving section is structured by the pair of clamp portions clamping the terminal between the pair of clamp portions, and tops of the plurality of projections in the direction, along which the pair of clamp portions approaches to each other, are arranged in one plane. Thereby, by operating a simple action to push the tops of the pair of clamp portions arranged in the one plane in the direction, along which the pair of clamp portions approaches to each other, the terminal can be received in the terminal receiving section.

According to the present invention claimed in claim 3, the terminals are arranged with the space to each others, and the plurality of terminal receiving sections is connected to each other in the direction which the plurality of terminals is arranged in, and the terminal receiving sections adjacent to each other are arranged at respective positions different from each other in the direction of intersecting both the lengthwise direction of the electric wire and the direction, along which the plurality of terminals is arranged. Thereby, the surface area of the terminal receiving section is more increased, so that the connector which is further improved about heat radiation can be provided.

DESCRIPTION OF EMBODIMENTS

Figure 1:
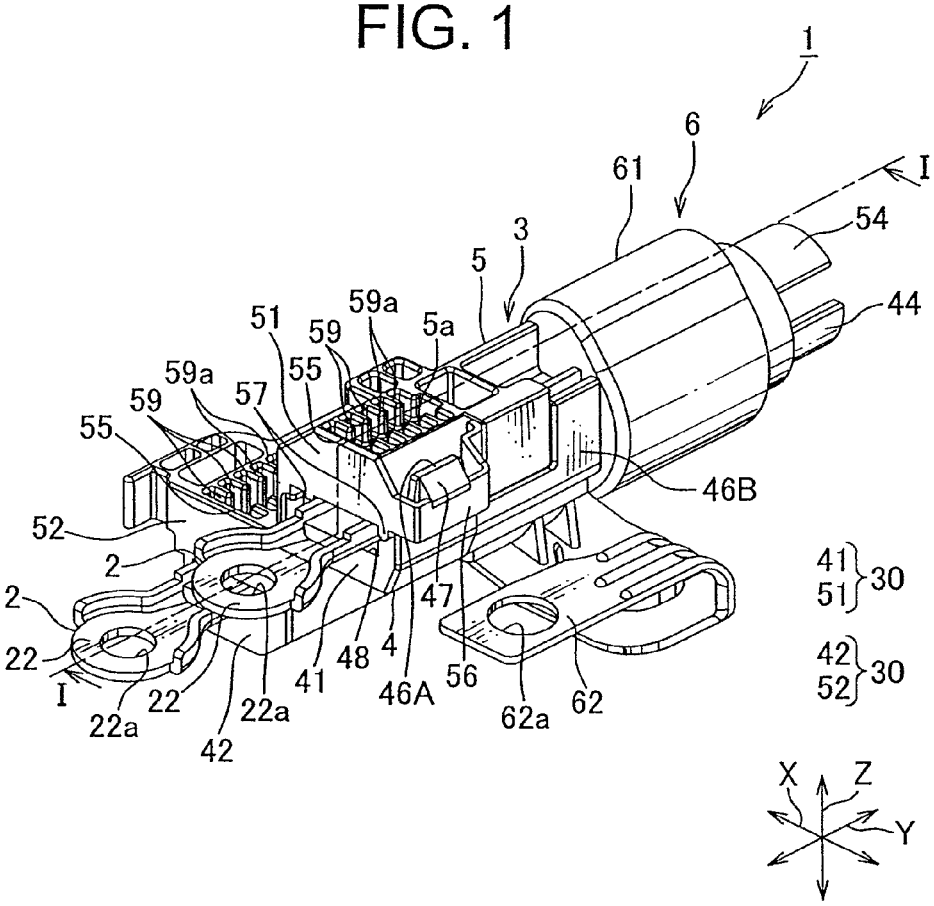
FIG. 1 is a perspective view of a connector of an embodiment according to the present invention.

A connector as an embodiment according to the present invention is described with reference to drawings FIGS. 1-5.

The connector 1 shown in FIGS. 1 and 2 includes a not-shown shielded electric wire, a plurality of terminals 2 to be connected respectively with a later-described plurality of covered electric wires of the shielded electric wire, a connector housing 3 receiving the plurality of terminals 2, and a shield shell 6 attached to the connector housing 3. A direction by arrow Y shown in FIG. 1 indicates a direction of lengthwise of the shielded electric wire (covered electric wires). A direction by arrow X indicates a direction, along which the plurality of terminals 2 is arranged. A direction by arrow Z is a direction intersecting both the directions by arrows Y and X, and indicates a direction, along which later-described pairs of clamp portions 41, 42 and 51, 52 of the connector housing 3 approach to each other. In FIG. 2, the terminal 2 clamped by the clamp portions 42, 52 is omitted.

The shielded electric wire includes a plurality of covered electric wires (call electric wire, hereafter) each having an electric conductive core wire and a cover covering the core wire; a shield braid formed by braiding a electric conductive metal material so as to cover the plurality of electric wires into one and limiting leakage of electric noise toward outside, and an insulating outer sheath covering the shield braid.

Figure 3:
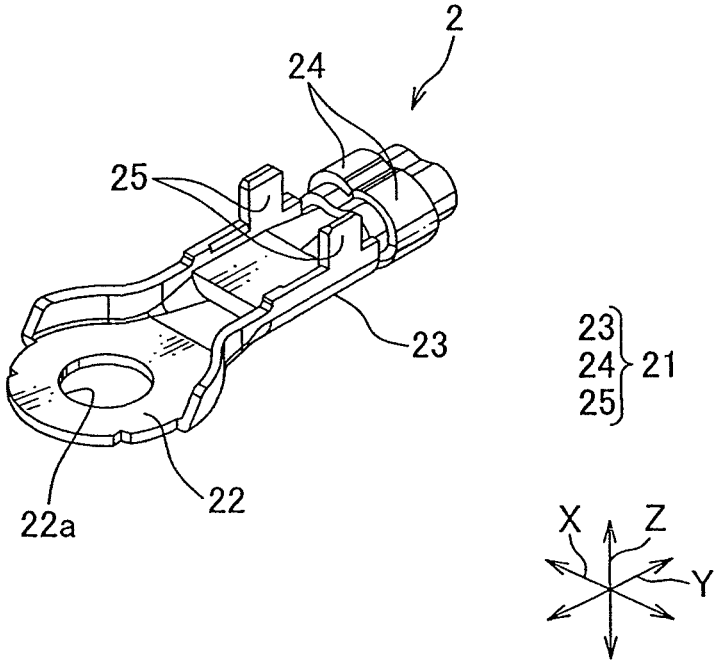
FIG. 3 is a perspective view of a terminal structuring the connector shown in FIG. 1.

The plurality of terminals 2 is arranged at a space between each other along the direction by arrow X. Each of the terminal 2 is formed by punching a conductive sheet metal and bending it. The terminal 2, as shown in FIG. 3, includes a wire connecting portion 21 and an electric contact portion 22 continuous to the wire connecting portion 21 as one body.

The electric connecting portion 21 includes a rectangular-shaped bottom plate 23, a pair of cover clamp pieces 24 arranged at one (top) end along a lengthwise direction (direction by arrow Y) of the bottom plate 23, and a pair of core-wire clamp pieces 25 at the other end along the lengthwise direction (direction by arrow Y) of the bottom plate 23, as one body. A lengthwise direction (by arrow Y) of the wire connecting portion 21 (that is terminal 2) and the lengthwise direction (by the arrow Y) of the electric wire to be connected with the wire connecting portion 21 are arranged in parallel to each other.

The above-mentioned cover clamp pieces 24 extend perpendicularly from both side edges of the bottom plate 23 along a widthwise direction thereof (direction by arrow X). The pair of cover clamp pieces 24 is bent so as to make its top ends at sides far from the bottom plate 23 approach the bottom plate 23. The pair of cover clamp pieces 24 clamps the cover of the electric wire between the bottom plate 23 and itself so as to grip the cover, so that the electric wire is joined mechanically by the cover clamp pieces 24.

The above-mentioned pair of core-wire clamp pieces 25 extends vertically from both side edges along the widthwise direction of the bottom plate 23. An end of the pair of core-wire clamp pieces 25, which end is at far side from the bottom plate 23, is bent so as to approach the bottom plate 23. The core wire, which is exposed by peeling the cover of the electric wire, is clamped between the pair of core-wire clamp pieces 25 and the bottom plate 23, and connected electrically with the core-wire clamp pieces 25 by cramping the core wire.

The electric contact portion 22 is continuous to the bottom plate 23 of the wire connecting portion 21. The electric contact portion 22 is formed into a round shape in top view, and a hole 22*a*, which a not-shown bolt is inserted through, is provided at the center of the electric contact portion 22.

The connector housing 3 is made of insulation synthetic resin. The connector housing 3, as shown in FIG. 1, includes a bottom housing 4 having a plurality of lower clamp portions 41, 42, and a top housing 5 having a plurality of upper clamp portions 51, 52, which the bottom housing 4 is mounted on. The connector housing 3 is provided with a plurality of terminal receiving sections 30 receiving the terminal 2. Each of the terminal receiving sections 30 is formed by the lower clamp portions 41, 42 of the bottom housing 4 and the upper clamp portions 51, 52 of the top housing 5, and the upper clamp portions 51, 52 are mounted to the lower clamp portions 41, 42. The lower clamp portions 41, 42 and the upper clamp portions 51, 52 correspond to a pair of clamp portions described in claims.

Figure 4:
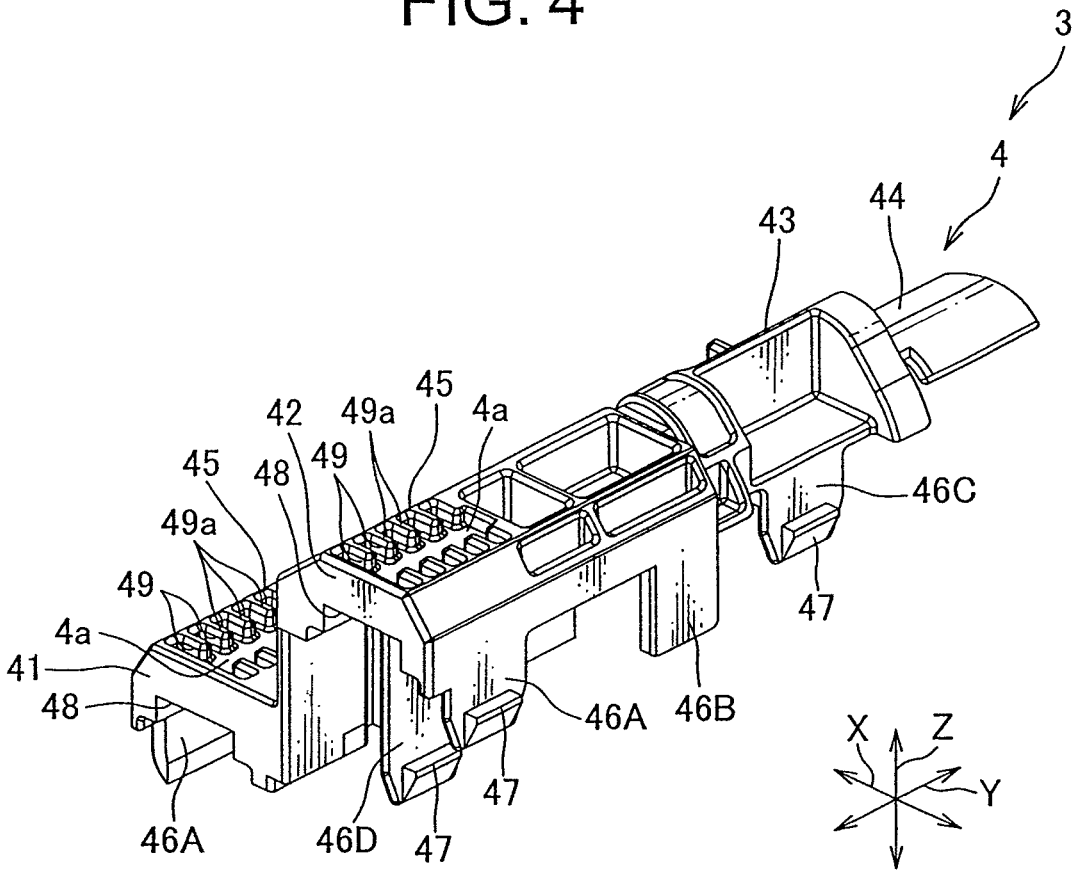
FIG. 4 is a perspective view of a bottom housing structuring the connector shown in FIG. 1.

The bottom housing 4, as shown in FIG. 4, includes the plurality of rectangular-shaped lower clamp portion 41, 42, a shell mount portion 43, a jutting portion 44, a plurality of heat radiating portions 45, a plurality of vertical extending portions 46A, 46B, 46C and a plurality of locking portions 47. The lower clamp portions 41, 42 are arranged at an end in the direction by arrow Y of the bottom housing 4. The jutting portion 44 is arranged at an end of the bottom housing 4, the end of which is at a side far from the lower clamp portions 41, 42 in the direction shown with arrow Y. The shell mount portion 43 is arranged between the lower clamp portions 41, 42 and the jutting portion 44. FIG. 4 is a view of viewing the lower housing 4 of the connector housing 3 shown in FIG. 1 when viewing from a lower side in the direction by arrow Z in FIG. 1.

The plurality of lower clamp portions 41, 42 is connected along the direction by arrow X, and the lower clamp portions 41, 42, which are adjacent to each other, are arranged at positions different to each other in the direction by arrow Z. In other words, the lower clamp portions 41, 42 adjacent to each other are arranged to be staggered in the direction by arrow Z, and the lower clamp portion 42 shown at this side in FIG. 4 is arranged higher in the direction by arrow Z than the lower clamp portion 41 shown at that side in FIG. 4.

Each of the lower clamp portions 41, 42 is provided with a groove 48 receiving the wire and the terminal 2 joined with the wire. The grooves 48 are formed to be recessed respectively from an inner surface in the direction by arrow Z of the lower clamp portions 41, 42.

The shell mount portion 43 is assembled with a later-described shell mount portion 53 of the top housing 5. When the later-described shell mount portion 53 of the top housing 5 is mounted at the shell mount portion 43, the shell mount portions 43, 53 are formed to cylindrical shape. The shell mount portion 43 positions the electric wire joined with the terminal 2 between the later-described shell mount portion 53 and itself. Around an outer surface of the shell mount portions 43, 53, a shield shell 6 is mounted.

The jutting portion 44 is formed into a plate shape. The jutting portion 44 is formed so as to project along the direction by arrow Y, and arranged to oppose along the direction by arrow Z to a later-described jutting portion 54 arranged at the top housing 5. The electric wire joined with the terminal 2 is positioned between the jutting portions 44, 54.

The plurality of heat radiating portions 45 is arranged respectively at each of the lower clamp portions 41, 42. The heat radiating portions 45 are arranged at an end of each of the lower clamp portions 41, 42, the end of which is at a side far from the shell mount portion 43 in the direction by arrow Y. In other words, the radiating portions 45 are arranged at positions at which the lower mount portions 41, 42 cover the wire connecting portion 21. The heat radiating portion 45 is formed by arranging a plurality of projections 49 projecting from a bottom surface 4*a* recessed from an outer surface opposite to the inner surface of the lower clamp portion 41, 42. Top portions 49*a*, at a far side from the lower clamp portions in the direction by arrow Z, of the plurality of projections 49 is formed in one plane. The bottom surface 4*a* corresponds to a surface (of the terminal receiving section 30) described in claims.

The plurality of vertical extending portions 46A, 46B are arranged at each of the lower clamp portions 41, 42. The vertical extending portion 46A extend vertically along the direction by arrow Z from an edge of the lower clamp portion 41, the edge of which is at a far side from the lower clamp portion 42 in the direction by arrow X. The vertical extending portion 46B extend vertically along the direction by arrow Z from an edge of the lower clamp portion 42, the edge of which is at a far side from the lower clamp portion 41 in the direction by arrow X. The vertical extending portion 46A is arranged respectively at a side far from the shell mount portion 43 in the direction by arrow Y of the lower clamp portions 41, 42. The vertical extending portion 46B is arranged respectively at a side near to the shell mount portion 43 in the direction by arrow Y of the lower clamp portions 41, 42. The vertical extending portions 46A, 46B are arranged at intervals to each other in the direction by arrow Y. The vertical extending portion 46C is arranged at the shell mount portion 43, and extends vertically along the direction by arrow Z from an edge of the shell mount portion 43, the edge of which is at a side far from the lower clamp portion 41 in the direction by arrow X.

The plurality of locking portions 47 is respectively arranged at each of the vertical extending portions 46A, 46C. The plurality of locking portions 47 is respectively arranged at each end of the vertical extending portions 46A, 46C, the each end of which is far from the lower clamp portions 41, 42 in the direction by arrow Z. The plurality of locking portions 47 is respectively arranged at a surface of the vertical extending portions 46A, 46C of the lower clamp portion 42, the surface of which is far from the lower clamp portion 41 in the direction by arrow X and at a surface of the vertical extending portions 46A, 46C of the lower clamp portion 41, the surface of which is far from the lower clamp portion 42 in the direction by arrow X.

The lower clamp portion 42 is provided with a vertical extending portion 46D and a locking portion 47 arranged at the vertical extending portion 46D. The vertical extending portion 46D extends vertically in the direction by arrow Z from an edge of the lower clamp portion 42, the edge of which is near to the lower clamp portion 41 in the direction by arrow X. A dimension in the direction by arrow Z of the vertical extending portion 46D is formed to be longer than that of the vertical extending portions 47A, 46B and 46C. The lock portion 47 is arranged at an end of the vertical extending portion 46D, the end of which is far from the lower clamp portion 41 in the direction by arrow Z, and arranged at a surface of the vertical extending portion 46D of the lower clamp portion 42, the surface of which is far from the lower clamp portion 41 in the direction by arrow X.

Figure 5:
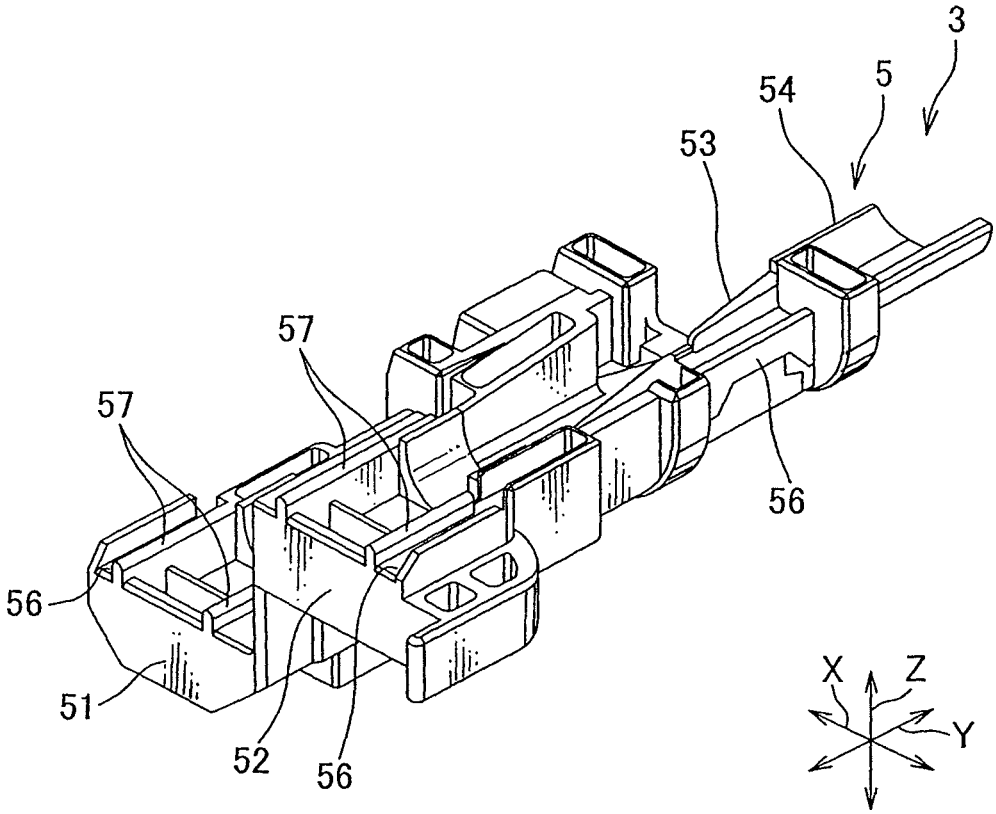
FIG. 5 is a perspective view of a top housing structuring the connector shown in FIG. 1.

The top housing 5, as shown in FIG. 5, includes a plurality of rectangular-shaped upper clamp portion 51, 52, a shell mount portion 53, a jutting portion 54, a plurality of heat radiating portion 55, a plurality of lock receiving portions 56. The upper clamp portions 51, 52 are arranged at an end of the top housing 5 in the direction by arrow Y. The jutting portion 54 is arranged at an end of the top housing 5, the end of which is far from the upper clamp portions 51, 52 in the direction by arrow Y. The shell mount portion 53 is arranged between the upper clamp portions 51, 52 and the jutting portion 54. FIG. 5 is a view of the top housing 5 of the connector housing 3 when viewing from the direction by arrow Z in FIG. 1.

The plurality of upper clamp portions 51, 52 is connected to each other along the direction by arrow X. The upper clamp portions 51, 52 adjacent to each other are arranged at positions different to each other in the direction by arrow Z. In other words, the upper clamp portions 51, 52 adjacent to each other are arranged to be staggered in the direction by arrow Z, and the upper clamp portion 52 shown at this side in FIG. 5 is arranged higher in the direction by arrow Z than the upper clamp portion 51 shown at that side in FIG. 5. Thus, the plurality of terminal receiving sections 30 structured by the lower clamp portions 41, 42 of the bottom housing 4 and the upper clamp portions 51, 52 of the top housing 5 are connected along the direction by arrow X, and the terminal receiving sections 30 adjacent to each other are arranged at positions different from each other in the direction by arrow Z.

Each of the upper clamp portions 51, 52 is provided with a pair of projections 57. The pair of projections 57 is arranged at interval to each other in the direction by arrow X and the wire connecting portion 21 of the terminal is placed between the pair of projections. The projections 57 are formed to project from each of inner surfaces of the upper clamp portions 51, 52, the inner surfaces of which are placed on the inner surface of the lower clamp portions 41, 42. The projections 57 extend along the direction by arrow Y.

The jutting portion 54 is formed into plate shape. The jutting portion 54 is arranged so as to jut toward the direction by arrow Y.

The plurality of heat radiating portions 55 is arranged at each of upper clamp portions 51, 52. The each heat radiating portions 55 are arranged at positions opposite to the heat radiating portions 45 of the bottom housing 4. In other words, each heat radiating portion 55 is arranged at a position in which the upper clamp portions 51, 52 cover the wire connecting portion 21. The each heat radiating portions 55 is formed by arranging the plurality of projections 59 at intervals to each other, which are formed to project from a bottom surface 5*a* recessed from an outer surface opposite to an inner surface of the top housing 5, which inner surface is placed on the inner surface of the bottom housing 4. Tops 59*a* of the plurality of projections 59, the tops 59*a* of which are far from the upper clamp portions 51, 52 in the direction by arrow Z, are formed in one plane. The bottom surface 5*a* corresponds to a surface (of the terminal receiving section 30) described in claim.

The lock receiving portions 56 are formed so as to be lockable with the locking portions 47 of the vertical extending portions 46A, 46C. Each lock receiving portion 56 is formed into a frame shape, through which the locking portion 47 and the vertical extending portion 46A, 46C provided with the locking portion 47.

The lock portion 58 (shown in FIG. 2) is arranged at an end of the shell mount portion 54 at a side far from the upper clamp portion 51, 52 in the direction by arrow Y, and formed so as to project in the direction by arrow Y. The lock portion 58 is formed to be lockable with a later-described lock receive portion 63 of the shield shell 6.

A not-shown lock receiving portion, to which the lock portion 47 arranged at the vertical extending portion 46D is locked, is provided at the upper clamp portion 52.

Figure 2:
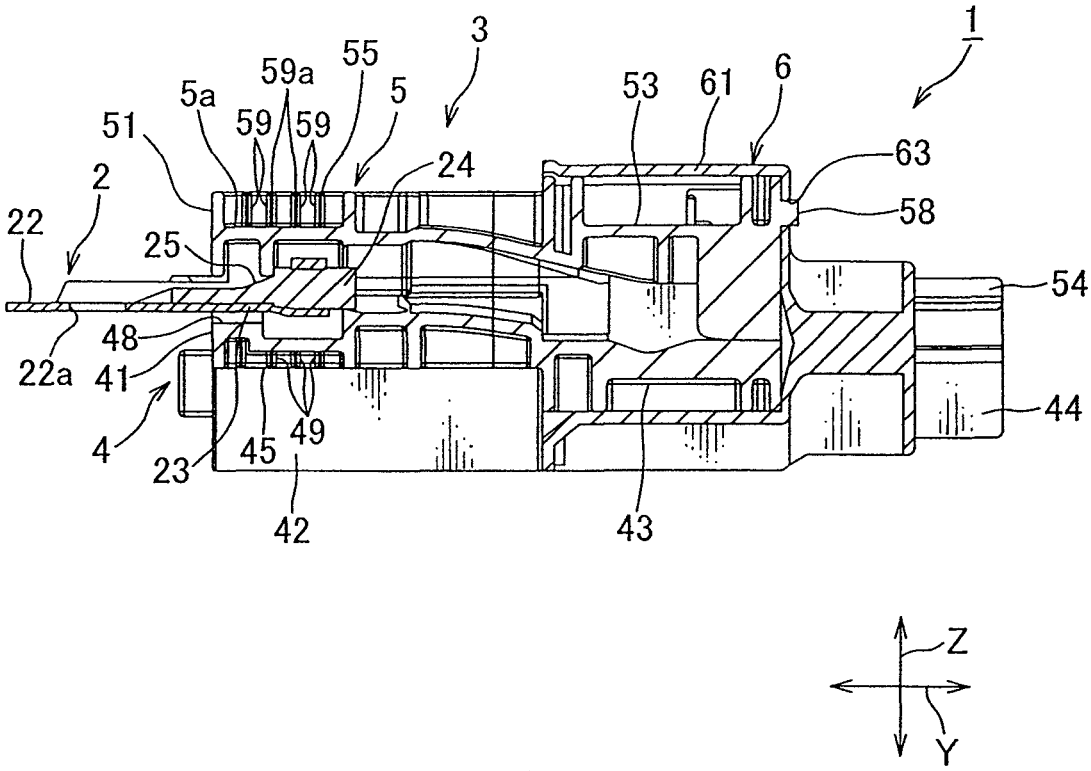
FIG. 2 is a cross-sectional view of the connector taken along the line I-I shown in FIG. 1.

The shield shell 6, as shown in FIGS. 1, 2, includes a shell main body 61 covered by an end of the shield braid of the shield wire, a shield ring (not shown) connecting the shield wire and the shield shell main body 61 covered by the end of the shield braid to each other, and an earth member 62.

The shell main body 61 is made of electric conductive metal. The shell main body 61 includes a lock receive portion 63 locked with the lock portion 58 of the connector housing 3.

The earth member 62 (shown in FIG. 2) is made of electrically conductive metal. The earth member 62 is arranged at the shell main body 61. The earth member 62 includes a through hole 62*a*, which a not-shown bolt is inserted through. By inserting the bolt through the through hole 62*a*, the earth member 62 fixes the shell main body 61, which the shield braid is connected at, to a car main panel (body) structuring a car.

The above-mentioned connector 1 is assembled as following. Each end of the electric wires is positioned on the bottom plate 23 of the wire connecting portion 21 of the terminal 2. By clamping the clamp pieces 24, 25 so as to approach the bottom plate 23, each electric wire is connected to the terminals 2. The electric wire and the wire connecting portion 21 connected with the electric wire are mounted in the groove 48 of the lower clamp portion 41, 42 of the bottom housing 4. At the time, the electric contact portion 22 of the terminal 2 is arranged so as to project from the bottom housing 4 in the direction by arrow Z.

The top housing 5 is aligned about the bottom housing 4 so as to oppose each of the clamp portions 41 and 51, each of the clamp portions 42 and 52; each of the shell mount portions 43 and 53; and each of the jutting portions 44 and 54 to each other along the direction by arrow Z so that the lock portion 47 of the vertical extending portion 46D of the bottom housing 4 is moved to approach the lock receive portion of the top housing 5. Thus, the bottom housing 4 and the top housing 5 are positioned to each other. Thereafter, by moving the housings 4 and 5 to approach each other furthermore, the terminal 2 is positioned between the pair of projections 57 of the top housing 5, and the lock portion 47 of the vertical extending portion 46D is locked at the lock receive portion, and each of the lock portions 47 of the vertical extending portions 46A, 46C, 46D is locked with each of the lock receiving portions 56. When each of the lock portions 47 of the vertical extending portions 46A, 46C, 46D is locked with each of the lock receiving portions 56, each of the clamp portions 41 and 51, and each of the clamp portions 42 and 52 are engaged with each other, so that the plurality of terminal receiving section 30 is assembled. The terminal receiving sections adjacent to each other are positioned respectively at positions different from each other in the direction by arrow Z as shown in FIG. 1.

Furthermore, the shell main body 61 is covered by the end of the shield braid, and the shield braid and the shell main body covered by the shield braid are connected to each other by the shield ring. Then, the shell main body 61 covered by the shield braid is moved to be close to the outer surface of the shell mount portions 43, 53. Thereby, the lock portion 58 is engaged with the lock receive portion 63 arranged at the shield shell 6, so that the shield shell 6 is mounted at the connector housing 3. Thereafter, the bolt is inserted through the through hole 62*a* of the earth member 62, and the shell main body 61 is mounted at the car panel (body) structuring the car. The electric noise flows through the shell main body 61 and the earth member 62 of the shield shall 6 to the car panel (body) as an earth. Thus, the connector 1 is assembled.

According to the above embodiment, the connector 1 includes the terminal 2 having the wire connecting portion 21 to be connected with the electric wire, and the connector housing 3 having the terminal receiving section 30 receiving the terminal 2. The terminal receiving section 30 includes the heat radiating portions 45, 55 arranged at the position of covering the wire connecting portion 21. At each of the heat radiating portions 45, 55, the plurality of projections 49, 59 formed by projecting from the surface 4*a*, 5*a* of each of the terminal receiving sections 30 is arranged at intervals to each other, so that the surface area of each of the terminal receiving sections 30 is increased. Thereby, the heat generated by the contact resistance between the electric wire and the terminal 2 connected with the electric wire can be easily diffused (radiated). The heat radiating portions 45, 55 are arranged at the positions of covering the wire connecting portion 21, at which heat is generated by the contact resistance, so that the heat can be efficiently radiated. Therefore, the connector 1, which heat radiation efficiency is improved, can be provided.

The terminal receiving section 30 is formed by the pair of clamp portions 41, 51 (clamp portions 42, 52) clamping the terminal 2 therebetween. The both of top portions 49*a*, 59*a* of the plurality of projections 49, 59 at a facing side of a direction of approaching each other (in the direction by arrow Z) is formed in the same plane, so that by easy operation of pushing the plurality of top portions 49*a*, 59*a* in the direction (direction by arrow Z) to approach the pair of clamp portions 41 and 51 (clamp portions 42 and 52) to each other, the terminals 2 can be received in the terminal receiving sections 30.

The terminals 2 are arranged at intervals to each other, and the plurality of terminal receiving sections 30 is arranged so as to be connected to each other in a direction of arranging the plurality of terminals 2 (direction by arrow X). The terminal receiving sections 30 adjacent to each other are arranged at positions different from each other in the intersecting direction (direction by arrow Z) intersecting both of the lengthwise direction of the electric wire (direction by arrow Y) and the direction of arranging terminals 2 (direction by arrow X), so that the surface area of the terminal receiving sections 30 can be further increased. Therefore, the connector 1, which heat radiation efficiency is more improved, can be provided.

According to the above embodiment, the plurality of terminal receiving sections 30 is arranged at the connector housing 3. According to the present invention, it is not limited in the above embodiment, at least one terminal receiving section 30 can be provided.

According to the above embodiment, each of the terminal receiving sections 30 is provided at both of the lower clamp portions 41, 42 and the upper clamp portions 51, 52 with the heat radiating portions 45, 55. According to the present invention, it is not limited in the above embodiment, the heat radiating portion 45, 55 can be arranged at at least one of the lower clamp portions 41, 42 and the upper clamp portions 51, 52.

The present inventions are described based in the embodiments as mentioned above, but the present invention is not limited in above embodiments. Various change and modifications can be made with the scope of the present invention.

The invention claimed is:

1. A connector, comprising:

a first terminal including a wire connecting portion, which an electric wire is joined to; and a connector housing including a first terminal receiving section receiving the first terminal so as to cover the wire connecting portion of the first terminal, wherein the first terminal receiving section is provided with a pair of clamp portions clamping the first terminal therebetween, wherein the pair of clamp portions each have a surface that is provided with a heat radiating portion having a plurality of projections extending away from the wire connecting portion so as to cover the wire connecting portion of the first terminal, and wherein the plurality of projections is arranged at intervals to each other.

2. The connector according to claim 1, wherein tops of the plurality of projections are arranged in one plane in a direction, along which the pair of clamp portions approaches to each other.

3. The connector according to claim 1, further comprising:

a second terminal arranged at an interval to the first terminal in a first direction; and a second terminal receiving section adjacent to the first terminal receiving section, wherein the first and second terminal receiving sections are staggered so as to be respectively arranged at positions different from each other in a direction intersecting both a lengthwise direction of the electric wire and the first direction.

4. The connector according to claim 2, further comprising:

a second terminal arranged at an interval to the first terminal in a first direction; and a second terminal receiving section adjacent to the first terminal receiving section, wherein the first and second terminal receiving sections are staggered so as to be respectively arranged at positions different from each other in a direction intersecting both a lengthwise direction of the electric wire and the first direction.

5. A connector, comprising:

a first terminal including a wire connecting portion, which an electric wire is joined to; and a connector housing including a first terminal receiving section receiving the first terminal so as to cover the wire connecting portion of the first terminal, wherein the first terminal receiving section is provided with a first surface covering the wire connecting portion and a second surface covering the wire connecting portion and opposed to the first surface, wherein on the first surface of the first terminal receiving section is formed a first plurality of projections, wherein on the second surface of the first terminal receiving section is formed a second plurality of projections, and wherein the wire connecting portion of the first terminal is covered by the first plurality of projections and the second plurality of projections of the first terminal receiving section.

* * * * *